United States Patent [19]

Barr

[11] Patent Number: 4,489,995

[45] Date of Patent: Dec. 25, 1984

[54] ADJUSTABLE ELECTRICAL OUTLET ASSEMBLY

[75] Inventor: Roger W. Barr, Niles, Mich.

[73] Assignee: Tyler Refrigeration Corporation, Niles, Mich.

[21] Appl. No.: 292,949

[22] Filed: Aug. 14, 1981

[51] Int. Cl.[3] ..... A47B 77/08; A47F 3/04

[52] U.S. Cl. ..... 312/236; 312/116; 312/223; 62/256; 339/126 R

[58] Field of Search ..... 312/236, 223, 116, 117, 312/119, 214; 62/256; 339/126 R, 127 C; 248/295.1

[56] References Cited

U.S. PATENT DOCUMENTS

| | | | |
|---|---|---|---|
| 1,575,988 | 3/1926 | Gleerup-Moller | 312/223 |
| 1,731,661 | 10/1929 | Hauenstein | 339/126 R |
| 2,005,623 | 6/1935 | Heyer | 312/223 |
| 2,241,854 | 5/1941 | Hall et al. | 62/256 |
| 2,817,826 | 12/1957 | O'Mara | 339/126 R |
| 2,998,951 | 9/1961 | Henderson | 248/295.1 |
| 3,277,234 | 10/1966 | Dekko et al. | 339/126 R |
| 3,392,543 | 7/1968 | Miller | 62/256 |
| 3,662,085 | 5/1972 | Robinson et al. | 339/126 R |
| 3,751,653 | 8/1973 | Henry | 312/116 |
| 4,302,946 | 12/1981 | Ibrahim | 62/256 |

FOREIGN PATENT DOCUMENTS

| | | | |
|---|---|---|---|
| 739101 | 7/1966 | Canada | 339/126 R |
| 901498 | 7/1962 | United Kingdom | 312/116 |

*Primary Examiner*—Victor N. Sakran

*Attorney, Agent, or Firm*—LeBlanc, Nolan, Shur & Nies

[57] ABSTRACT

An electric outlet assembly adapted for mounting in an opening in a wall to secure a current take-off means at various fixed positions relative to the opening. The take-off means is mounted in a cover member which is arranged to block the opening at all positions at which the current take-off means is secured. Positive or negative air pressure can be maintained within the wall. The wall can be an air conduit partition in a refrigerated display cabinet.

12 Claims, 7 Drawing Figures

ADJUSTABLE ELECTRICAL OUTLET ASSEMBLY

BACKGROUND OF THE INVENTION

The present invention relates to an electrical outlet assembly which can be adjusted to different positions relative to a support wall. The outlet assembly is of particular utility in refrigerated display cabinets.

The term "refrigerated cabinets" in accordance with the present invention is intended to incorporate those cabinets or cases maintained at a temperature of 32° F. or more, such as display cases utilized for the storage of milk and fresh foods, and those cases maintained below 32° F., such as frozen food cases.

The utility of refrigerated display cabinets in food stores and supermarkets depends, in part, upon the provision of adequate illumination of the products displayed in the cabinets. In addition, provision must be made for the maintenance of a cold air mass within the cabinet and for elevation of the products in a shelf structure, where possible. In such elevated structure cabinets having shelves, adequate illumination is a problem since the top cowl structure of the display cabinet and the shelves themselves block ambient lighting from the store ceiling lights.

One solution to the illumination problem is to mount light sources such as fluorescent light bulbs on the undersurfaces of the leading edges of the shelves in order to illuminate the products stored on the shelves immediately below the shelf on which the light fixture is affixed. The lighting fixtures are provided with electrical connector plugs which fit into conventional electric outlets. In such refrigerated cases, the electric outlets are mounted in the rear wall panels of the display cabinets which also form air conduits for the circulated refrigerated air. The shelves are also adjustable in vertical position which results in blockage of the electrical outlets at some of the vertical shelf positions.

Prior patents show various arrangements for providing linear adjustments of electrical outlets wherein the outlet is simply moved along a track. Great Britain Pat. No. 1,042,844 shows a linearly movable outlet held in a "girder" 1. Some of the prior patents show electrical conductors mounted within an elongated insulation housing on which the electrical outlet is moved while in electrical contact with the conductors. This form of electrical outlet is regarded as overly expensive for many applications such as in display cabinets and also requires special and costly modifications of the rear panel walls and/or shelf structure in order to accommodate use of the same. Representative patents of this type of movable electrical outlet are U.S. Pat. Nos. 1,812,956 to S. F. Howk; 2,261,986 to W. H. Frank et al; 2,617,849 to E. N. Wright et al; and 2,669,632 to H. J. Hammerly.

SUMMARY OF THE INVENTION

An electrical outlet assembly adapted for mounting in an opening in a support wall is provided in which an electrical current take-off means or electrical receptacle is mounted in a cover member which is movable relative to the opening. The cover member is arranged to block the opening in the support wall at all positions of the current take-off means relative thereto. Means are also included for variably securing the cover plate in fixed positions relative to the opening so that linear adjustment of the outlet assembly is conveniently provided. The cover member blocks the opening in the support wall so that a controlled air flow can be maintained within the support wall. The support wall can be an air conduit partition in an air conduit, a refrigerated display cabinet, or a heating duct which can be a solid or perforated panel. Refrigerated or heated air maintained within the conduit at an elevated pressure will not escape through the opening since the opening is always blocked by the cover member.

In the preferred form the current take-off means is a "female" electrical plug connector receptacle which is sometimes referred to as an adaptor receptacle.

It is therefore an object of the present invention to provide an electrical outlet assembly which is mountable in a support wall opening and which enables adjustment of the position of a retained current take-off means along the surface of the wall.

Another object of the present invention is to provide a position-adjustable electrical assembly incorporating a means for variably securing an included current take-off means in various fixed positions relative to an opening in a support wall.

Yet another object of the present invention is to provide an electrical outlet assembly where the current take-off means is mounted in a position-adjustable fashion and consists of a plug connector receptacle.

Specific preferred embodiments of the invention will be described below with reference to the appended drawing Figures.

DESCRIPTION OF THE PREFERRED EMBODIMENTS

Figure 2:
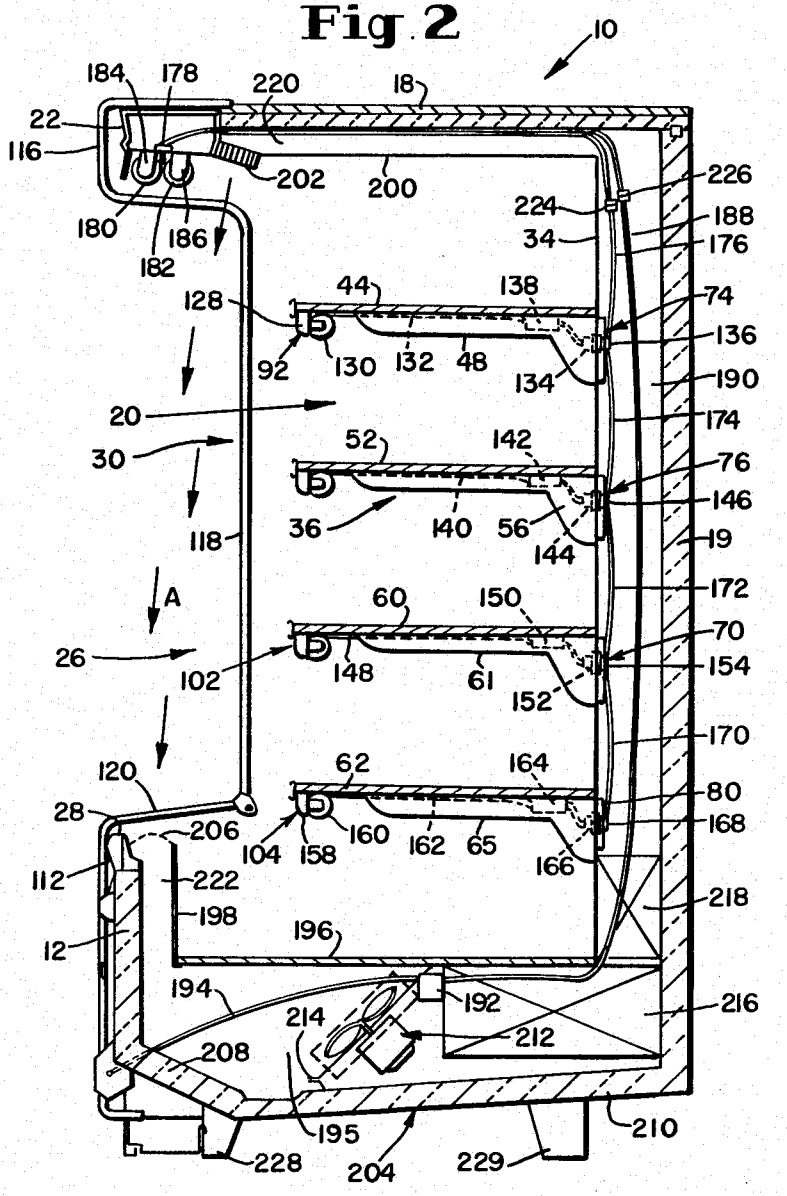
FIG. 2 is a cross-sectional schematic view of the merchandiser refrigerated display cabinet illustrated in FIG. 1.
Figure 1:
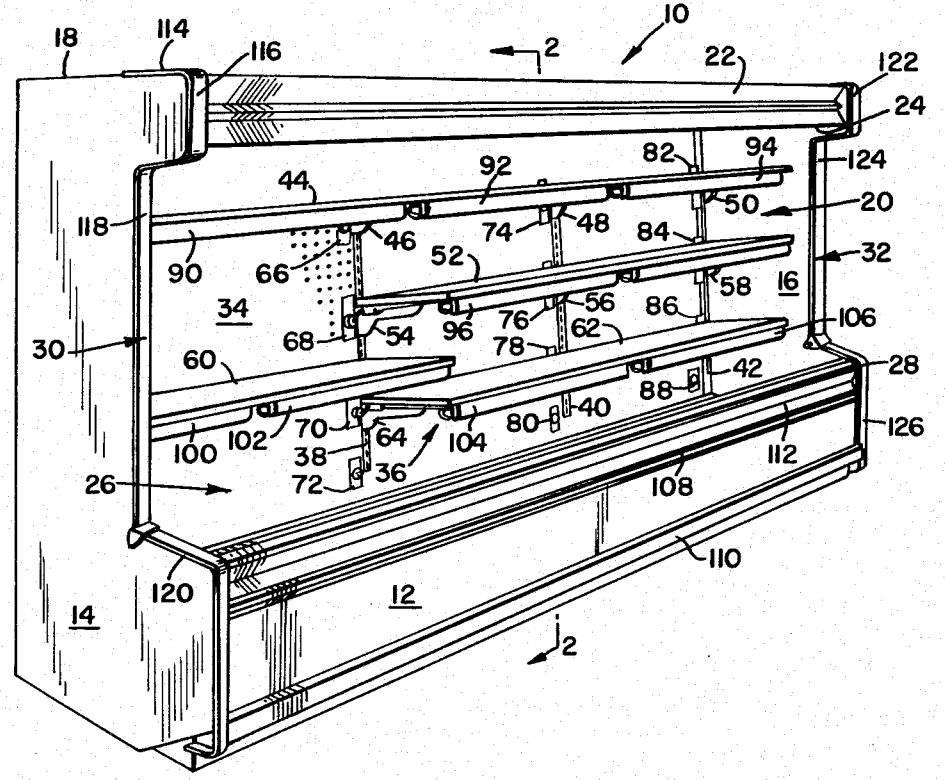
FIG. 1 is a perspective schematic view of an open-front reach-in merchandiser refrigerated display cabinet containing multiple electrical outlet assemblies according to the present invention.

Referring to FIGS. 1 and 2, an open-front refrigerated merchandiser cabinet 10 has a low front wall 12, end walls 14 and 16, top wall 18, and a rear wall 19 (shown in FIG. 2) which enclose a refrigerated display space 20. The front portion of top wall 18 is connected to a display hood 22 which forms the upper edge portion 24 of an access opening 26. The lower edge portion 28 of the display cabinet structure forming access opening 26 is the topmost portion of front wall 12. Side edge portions 30 and 32 in end walls 14 and 16, respectively, also define the vertical edges of access opening 26. Inside of cabinet 10 a rear wall panel 34 defines the interior plane of the display space 20.

A series of shelves 36 are attached to rear panel 34 for displaying products contained within merchandiser cabinet 10. The shelves can be adjustably arranged at different heights by securing the shelf brackets at different vertical positions on the shelf tracks 38, 40, and 42. A fourth shelf track (not shown) is positioned adjacent to the inside of end wall 14. Top shelf 44 is supported by shelf brackets 46,48 and 50 which are cleated into slots formed in the shelf upright tracks 38, 40 and 42, respectively. In a like manner, shelf 52 is supported by shelf brackets, 54, 56 and 58 which are also cleated into the same series of shelf tracks 38–42. Shelf 60 is shown positioned at the left-hand side within the product display space 20 and is supported by similar shelf brackets such as bracket 61 (FIG. 2). The lowest positioned shelf 62 is supported by shelf bracket 64 and corresponding shelf brackets such as 65 (FIG. 2) which cleat into shelf track 40. Electrical outlet assemblies 66, 68, 70 and 72 are shown positioned along one side of shelf track 38. A similar set of electrical outlet assemblies 74, 76, 78 and 80 are positioned along shelf track 40, and a third set of electrical outlet assemblies 82, 84, 86 and 88 are shown positioned along shelf track 42.

The display cabinet has lighting fixtures 90, 92 and 94 connected to the front undersurfaces of the shelf 44, fixtures 96 and 98 connected to shelf 52, fixtures 100 and 102 connected to shelf 60, and fixtures 104 and 106 connected to shelf 62 in order to provide illumination for the display space 20.

Front wall 12 also has provided on its outer surface an upper bumper rail 108 and a lower bumper rail 110. Various trim members usually constructed of chrome strips or colored plastic strips are provided for decoration of cabinet 10. An indented trim panel member 112 is shown attached to front panel 12. An end wall 14 is provided with a top trim strip 114, which has a front hood trim portion 116 and a vertical portion 118 which is connected to a lower trim strip portion 120. Similar end panel trim strips 122, 124 and 126 are provided for opposite end wall 16.

FIG. 2 shows the shelves 44, 52, 60 and 62 with the lighting fixtures 92, 96, 102 and 104, respectively, attached to the undersurfaces of the front edges thereof. The lighting fixtures are positioned at the front edge portions of the shelves to illuminate the product display spaces immediately below each of the shelves. Lighting fixture 92 has a fluorescent tube holder 128 with a fluorescent tube 130 positioned therein. The same construction is provided for light sources 96, 102 and 104. The tube holder 128 is connected by a grounded electrical line 132 to an electric plug 134 which is retained in a female receptacle 136 which is positioned in an electric outlet assembly 74 mounted in the rear wall panel 34. An electrical ballast box 138 is also provided in line 132. In a similar manner, lighting fixture 96 is connected via grounded electrical line 140 and through ballast box 142 to a male connector plug 144 which is, in turn, removably connected to a female electrical receptacle 146 retained in an electrical outlet assembly 76. Lighting fixture 102 attached to the undersurface of shelf 60 is connected via grounded electric line 148 and ballast box 150 to a plug 152 and a female receptacle 154 which is mounted in an outlet assembly 70. In like manner, lighting fixture 104 consists of fluorescent tube-holding bracket 158 and tube 160 which are connected via a grounded electrical 162 and ballast box 164 to male connector plug 166. Plug 166 is retained in female receptacle 168 mounted in an electrical outlet assembly 80. Electrical receptacles 168, 154, 146 and 136 are successively connected, in this order, to grounded electrical lines 170, 172 and 174, respectively. Receptacle 136 is then connected via electrical line 176 to control switch 178 positioned under display hood 22. Switch 178 controls both the shelf lighting fixtures and top fluorescent tubes 180 and 182, which are retained by holding brackets 184 and 186, respectively. A power line 188 is connected to switch 178 and is positioned to the rear side of wall panel 34 in an air conduit 190 formed between wall panel 34 and rear wall 19. Electrical power line 188 is connected to terminal block 192 which is in turn connected by an electric line 194 to a source of electric current. Block 192 is positioned in a bottom air plenum 195.

Each of the electric outlet assemblies 66, 68, 70, 72, 74, 76, 80, 82, 84, 86 and 88 are vertically adjustable along wall panel 34 in a manner hereafter described. Due to this vertical adjustment feature, the independent vertical adjustment and repositioning of product shelves 44, 52, 60 and 62 shown in FIG. 2 does not result in blockage of the electric receptacles 136, 146, 154, and 168, which would occur if these receptacles were rigidly secured within the wall panel 34.

The construction and refrigerated operation of the display cabinet 10 can be understood by reference to FIG. 2, wherein the lowermost edge of the rear panel 34 is connected to a bottom divider panel 196 which is in turn connected to a vertical front divider panel 198. The topmost edge of the rear panel 34 is connected a top divider panel 200 which has downwardly directed louvers 202 located along the front portion thereof. The divider panels 34, 196, 198, and 200 form the air conduit 190 in cooperation with the rear wall 19, top wall 18, and a bottom wall 204. The front divider panel 198 is connected to an air grille 206 which is, in turn, connected to front wall 12. Bottom wall 204 has a front inclined bottom portion 208 and a horizontal bottom wall portion 210.

Bottom air plenum 195 has a motor-driven air fan 212 retained therein by a bracket 214. Fan 212 generates an air band A which is refrigerated by means of contact with a first evaporator coil box 216 and a second coil box 218. The primary air band A is circulated by fan 212 in a counterclockwise direction and is ejected from conduit 190 through an air outlet 220 which has the downwardly directed louvers 202 fitted thereacross. The air stream A is drawn into an air inlet 222 located immediately below the air grille 206 to the inside of the lower edge portion 28 of cabinet 10.

If desired, doors (not shown) can be provided for closing the access opening 26 except for those times when customer access or defrost operations are carried out.

During the refrigeration cycle of operation moisture picked up from the ambient air accumulates in the form of frost and ice on the evaporator coils within the coil boxes 216 and 218. A defrosting method is then required to remove such frost and ice. One such method which can be carried out at low energy cost is the utilization of air defrost in which warm ambient air is drawn into the air conduit 190 so that it contacts the evaporator coils and melts the accumulated ice and frost. One method of achieving this air defrost in cabinet 10 is to reverse the direction of flow of the air band A by reversal of the direction of fan 212. In this mode of operation ambient air is drawn into the downwardly directedly louvers 202 at the top of cabinet 10 and is then caused to flow in a clockwise direction through the evaporator coil boxes 218 and 216 and is then ejected from the air grille 206 outwardly through the access opening 26 into the ambient air. Other methods of air defrost are set forth in other applications of the assignee of the present invention such as Ser. Nos. 141,359 and 141,360, both filed Apr. 18, 1980 by Fayez F. Ibrahim.

As seen in FIG. 2, various cabinet walls and panels such as top wall 18, rear wall 19, bottom wall 204, and bottom panel 196 can be heat insulated in order to provide a thermal barrier against heat transfer. If desired, electrical line connections 224 and 226 can be provided in lines 176 and 188, which, with lines 170, 172, and 174, constitute the electrical harness of the shelf lighting system. Also cabinet legs 228 and 229 can be provided under bottom wall 204.

Figure 3:
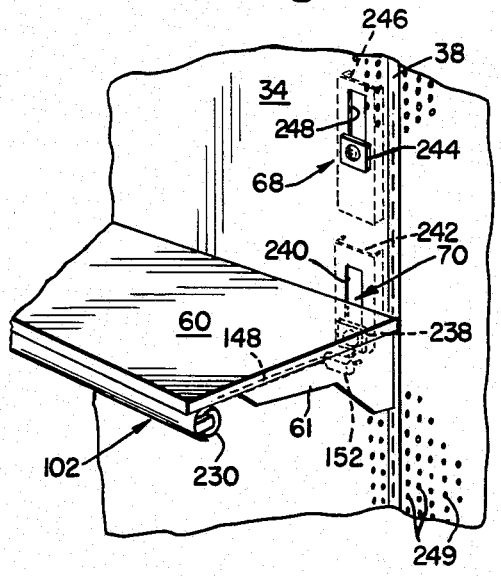
FIG. 3 is a perspective schematic view of a portion of the refrigerated cabinet of FIGS. 1 and 2 showing the relationship of two of the electrical outlet assemblies with a mounted shelf which supports a light source.
Figure 5:
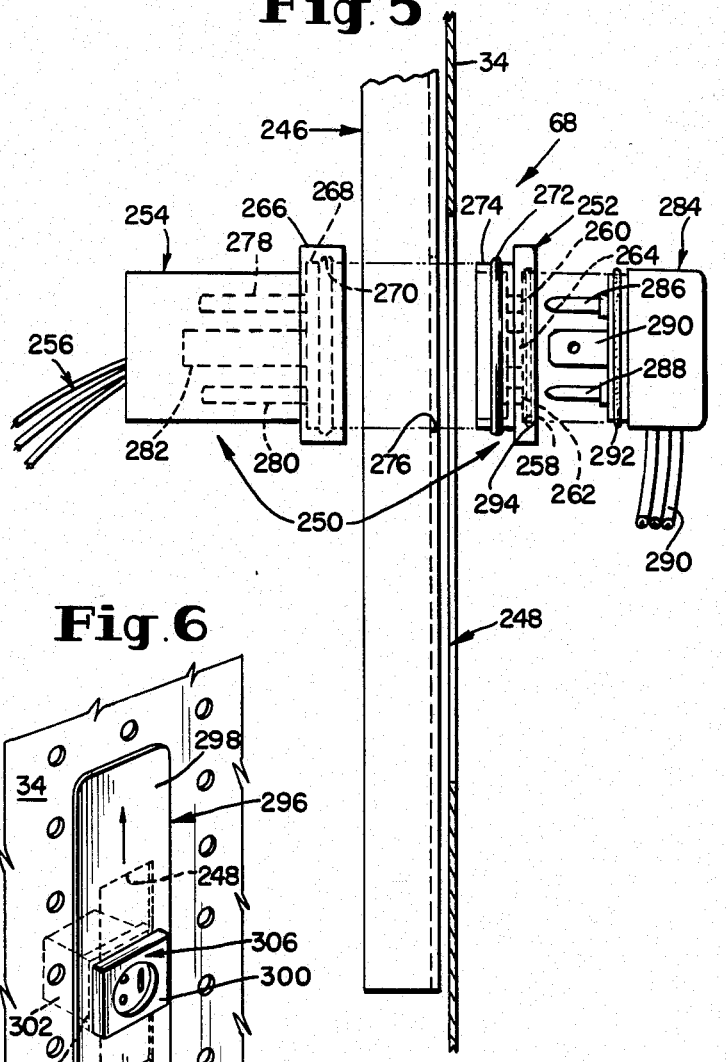
FIG. 5 is an exploded schematic side view of a modification of the electrical assembly illustrated in FIG. 4.
Figure 4:
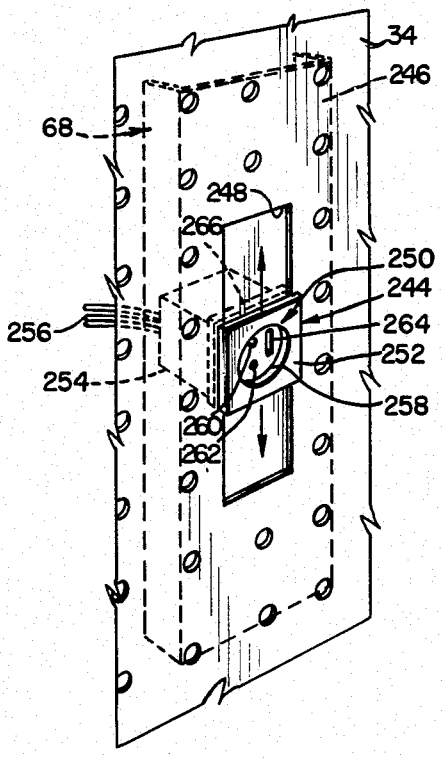
FIG. 4 is a perspective schematic view of an electrical outlet assembly mounted in a support wall according to the present invention.

Referring to FIGS. 3–5, more detailed views of the electrical outlet assemblies 68 and 70 are shown. The shelf upright track 38 is shown positioned against perforated rear wall panel 34 for supporting cleated shelf bracket 61 which supports shelf 60. The light fixture 102 is shown attached to the undersurface of the front edge portion of shelf 60 with a fluorescent tube 230 retained therein. The light fixture 102 is connected by the grounded electrical line 148 to a male electric connector plug 152 which is connected to the female receptacle 154 retained within the electrical outlet assembly 70. The electrical outlet assembly is positioned in and aligned with respect to a rectangular-shaped opening 240 formed in the rear panel 34. A cover member or plate 242 is shown positioned on the rear side of wall panel 34 in the outlet assembly 70. A similar female electrical receptacle 244 and a rear cover plate 246 are shown positioned in and aligned with a rectangular-shaped opening 248 for outlet assembly 68. The perforations 249 in rear wall panel 34 permit an even diffusion of the refrigerated air from air conduit 190 into display space 20. The cover plate 242 prevents leakage of the air out of openings 240 and 248 which would interfere with this diffusion.

As shown in FIGS. 4 and 5, electrical outlet assembly 68 consists of an electrical take-off means 250 which is arranged for sliding movement within opening 248. Cover member of plate 246 which is positioned to the rear side of the perforated wall panel 34 also slides during adjustment of the vertical position of take-off means 250. The current take-off means 250 is formed by a face plate 252 which can be rectangular or square in shape and a rear housing 254 from which a three conductor grounded power line 256 is taken and interconnected to the electrical harness located in air conduit 190. The face plate 252 contains a circular depression 258 which is configured to receive an electrical connector plug which has bayonet terminals for entering openings 260 and 262 and a grounding line connection for entering opening 264.

As shown in FIG. 5, the face plate 252 can be made separable from the rear housing 254 so that it extends horizontally across the opening 248 in order to contact the side edge portions thereof. A mating collar member 266 is connected to the front portion of the rear housing 254 and is formed with a recess 268 which is provided with a groove 270 about the interior thereof in a manner to mate with a bead 272 formed on the neck portion 274 which is formed on the rear side of face plate 252. An opening 276 is formed in cover member 246 for receiving the neck portion 274 and for permitting the resilient passage of bead 272 therethrough.

Collar 266 and neck portion 274 and bead 272 as well as cover face 252 are formed from a resilient elastomeric material such as white or black hard rubber, whereby the face plate exerts compressive force toward the collar 266 when clamped into position as shown in FIG. 4. In this position the neck portion 274 is retained within opening 276 in cover member 246 to provide means for securing the current take-off means 250 at adjustable vertical positions by reason of the elastic compressive force of the face plate 252 against the outer edge side portions of the rectangular slot 248.

The cover member 246 extends vertically beyond the rectangular slot 248 when the current take-off means 250 is positioned at either of the extreme upper or lower end portions thereof. The internal electrical connections within rear housing 254 are those conventionally present in electrical connector outlets in order to connect the bayonet receptacles 278 and 280 and the grounded terminal receptacle 282 to the three conductor electrical line 256. A male electrical plug 284 having bayonet connectors 286 and 288 and a grounding lug 290 and having a grounded power line 292 is also shown detached from the receptacle 250. A locking bead 292 on plug 284 and a matching groove 294 in face plate 252 are provided to facilitate a positive interfitting of the plug with the receptacle 250.

Figure 6:
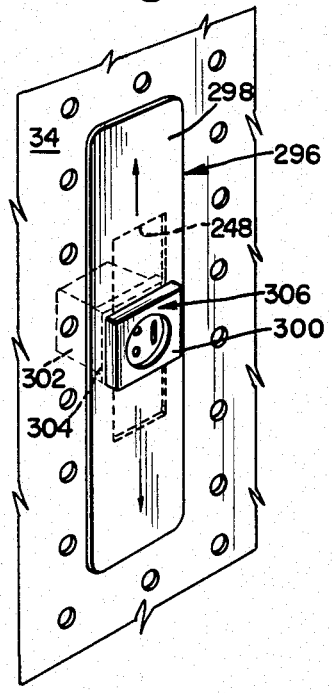
FIG. 6 is a perspective schematic view of a preferred form of the electrical outlet assembly according to the present invention.

As illustrated in FIG. 6, it is preferable to construct an electrical outlet assembly 296 in which an external cover member 298 is positioned on the outer surface of perforated rear wall panel 34 as an alternative to the rear positioned cover member 246 of FIGS. 2–5 and to interconnect a face plate 200 with a rear housing 302 so that the face plate of the assembly 298 is retained in various vertical positions with respect to the rectangular slot 248. In this preferred modification, compressive force is exerted between the face plate 300 and the rear edge portions of the slot 248 which are in contact with the collar 304 in order to retain the cover member 298 in a given position. This embodiment of the electrical outlet assembly 296 provides the advantages of giving greater protection against the outlet assembly being accidentally pushed into the air conduit and of being simpler to install during manufacturing of the refrigerated display case 10. The current take-off means 306 of assembly 296 consists of the face plate 300 and the housing 302.

Figure 7:
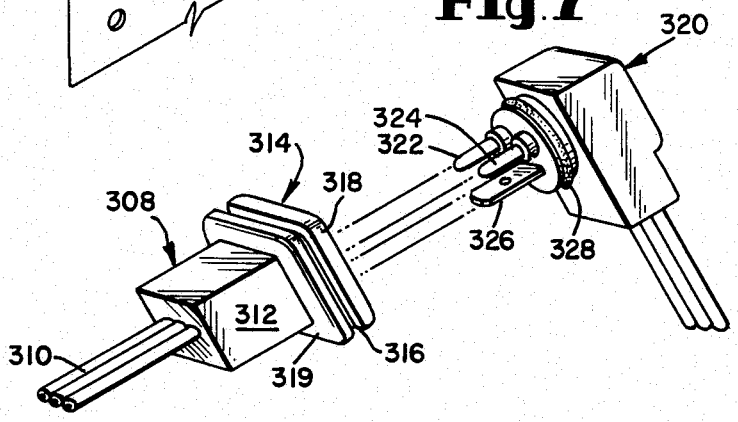
FIG. 7 is an exploded schematic view of a preferred embodiment of the current take-off means shown in FIGS. 4 and 6.

The current take-off means 250 and 306 illustrated in FIGS. 3–6 can be preferably molded as an integral piece whereby the face plates and housings are a single unit. FIG. 7 illustrates such an integrally molded electrical receptacle or current take-off means 308 in which the grounded connector line 310 is molded into the rear housing 312 and in which a combination cover plate and retainer collar 314 is integrally formed on the front side of the housing 312. A peripheral groove 316 is formed in collar 314 in order to provide means for retaining cover members 246 or 298 in compressed frictional engagement with the rear wall panel 34. The accommodating opening such as 276 in FIG. 5 in these cover members is sized and designed with sufficient flexibility to allow the outer portions 318 and 319 of the collar 314 to be forceably moved therethrough for mounting the cover members over their associated slots. A three-pronged male plug 320 is shown with the bayonets 322 and 324 and the grounding lug 326 removed from the receptacle 308. A molded bead 328 is also provided for the same function as bead 292 on plug 284.

In operation the current take-off means or receptacles 250, 306, and 308 described with respect to FIGS. 4–7 can be adjusted vertically within the rear wall panel 34 in order to avoid blockage of the outlet electrical openings by any of the shelves 44, 52, 60 or 62 which are used within display cabinet 10.

The various modifications of the present invention can be employed in the same refrigerated display cabinet.

The electrical outlet assemblies described can also be used in two air band cabinets with or without provision for and ambient air band as described in the above referenced applications Ser. Nos. 141,359 and 141,360 with considerably advantageous results in both perforated and solid panels thereof. The outlet assemblies can be used in a wide range of other wall structures as well, including heated and cooled air ducts, to provide for adjustment in any direction.

The present invention permits maximum lighting within the refrigerated display product space 20 and at the same time allows fully utilizable shelf spacing along the shelf upright tracks 38, 40, and 42.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A refrigerated display cabinet having spaced walls therein for forming at least one air conduit for enabling the circulation of refrigerated air and having vertically movable assembly means supported by one of said spaced walls, comprising at least one opening formed in a wall of said air conduit, a cover member in contact with said wall and arranged for vertical movement relative to and for blocking said opening, and an electrical current take-off means supported in said cover member, said cover member and said take-off means substantially flush with the side of said wall on which said assembly means is supported and means for securing said cover member in variable vertical positions relative to said opening for enabling said current take-off means to be used at different vertical positions to avoid blockage of said take-off means by said vertically movable assembly means.

2. The refrigerated display cabinet according to claim 1, wherein said current take-off means has at least one electrical conductor attached to one side thereof, and wherein said electrical conductor leads away from one side of said conduit wall, and wherein said cover member is positioned adjacent to said conduit wall on the same side as said electrical conductor.

3. The refrigerated display cabinet according to claim 1, wherein said current take-off means has at least one electrical conductor attached to one side thereof, and wherein said electrical conductor leads away from one side of said conduit wall, and wherein said cover member is positioned adjacent to said conduit wall on the opposite side from said electrical conductor.

4. The refrigerated display cabinet according to claim 1, wherein said electrical current take-off means is a plug connector receptacle.

5. The refrigerated display cabinet according to claim 1, wherein said electrical current take-off means is a unitary plug connector receptacle adapted to secure said cover member in variable vertical positions.

6. The refrigerated display cabinet according to claim 1, wherein said air conduit contains refrigerated air under a positive pressure with respect to ambient pressure.

7. The refrigerated display cabinet according to claim 1, wherein, said means for securing said cover member in variable vertical positions comprises resilient collar portions integrally formed on said current take-off means which are adapted to elastically compress said cover member against portions of said wall.

8. The refrigerated display cabinet according to claim 1, wherein said current take-off means comprises a housing portion containing electrical connectors, a face portion positioned on the opposite side of said wall from said housing portion, and wherein said cover member is positioned between said housing portion and said face portion.

9. The refrigerated display cabinet according to claim 8, wherein said means for securing said cover plate in variable vertical positions enables the exertion of compressive force between said housing and said face portions of said current take-off means.

10. A refrigerated display cabinet having spaced walls therein for forming at least one air conduit for enabling the circulation of refrigerated air, comprising at least one opening formed in a wall of said air conduit, a cover member arranged for movement relative to and for blocking said opening, and an electrical current take-off means supported in said cover member, and means for securing said cover member in variable vertical positions relative to said opening, said cabinet having a shelf adapted for being adjustably mounted at variable vertical positions on said wall, a lighting fixture attached to said shelf and wherein said current take-off means and said cover member are movable relative to said shelf to avoid blockage thereby, and wherein said light fixture has an electrical line connector adapted for connection to said current take-off means.

11. The improvement in a refrigerated display cabinet having spaced walls therein forming at least one air conduit for enabling the circulation of a refrigerated air band, said cabinet having at least one opening formed in a wall of said air conduits and having a shelf vertically adjustably mounted on said air conduit wall, the improvement comprising: a cover member arranged for movement relative to and adapted for blocking said opening, and an electrical current take-off means supported by said cover member, means for securing said cover member in variable vertical positions relative to said opening, and a lighting fixture having an electrical connector adapted for connection to said current take-off means affixed to said shelf.

12. The improvement in a refrigerated display cabinet having spaced walls therein forming at least one air conduit for enabling the circulation of a refrigerated air band, said cabinet having at least one opening formed in a wall of said air conduits, and having a shelf adapted for being adjustably mounted at variable vertical positions on said wall of said air conduit and a lighting fixture attached to said shelf, the improvement comprising: a cover member arranged for movement relative to and adapted for blocking said opening, and an electrical current take-off means supported by said cover member, means for securing said cover member in variable vertical positions relative to said opening, and said current take-off means and said cover member movable relative to said shelf to avoid blockage thereby.

* * * * *